United States Patent [19]

Gallina

[11] 4,399,649

[45] Aug. 23, 1983

[54] SPINNING FLYER CONSTRUCTION

[75] Inventor: Kurt Gallina, Fellbach, Fed. Rep. of Germany

[73] Assignee: C. Eugen Maier Metallverarbeitung GmbH, Fed. Rep. of Germany

[21] Appl. No.: 268,186

[22] Filed: May 29, 1981

[30] Foreign Application Priority Data

Jun. 24, 1980 [DE] Fed. Rep. of Germany ..... 3023546

[51] Int. Cl.[3] ..... D01H 7/26

[52] U.S. Cl. ..... 57/115; 57/117; 57/341

[58] Field of Search ..... 57/67, 115–117, 57/334, 341–343

[56] References Cited

U.S. PATENT DOCUMENTS

| | | | |
|---|---|---|---|
| 2,753,679 | 7/1956 | Von Schmoller et al. | 57/341 X |
| 2,814,926 | 12/1957 | Berberich | 57/115 |
| 2,867,970 | 1/1959 | Richter | 57/115 |
| 2,878,637 | 3/1959 | Bacon | 57/115 |
| 3,447,303 | 6/1969 | Loepfe | 57/115 |
| 3,498,040 | 3/1970 | Argereu | 57/115 |
| 4,122,653 | 10/1978 | Argereu | 57/115 X |

FOREIGN PATENT DOCUMENTS

| | | | |
|---|---|---|---|
| 399231 | 10/1942 | Italy | 57/115 |

*Primary Examiner*—John Petrakes
*Attorney, Agent, or Firm*—McGlew and Tuttle

[57] ABSTRACT

A spinning flyer comprises a rotatable flyer having spaced apart substantially parallel flyer arms with a central web portion. A head projects outwardly from the web portion in an opposite direction from the arms and a twist crown is slidably engageable over the head. The twist crown is nevertheless inhibited from removal from the head by a securing member in the form of an O-ring or similar elastic member engageable between the twist crown and the head.

2 Claims, 2 Drawing Figures

SPINNING FLYER CONSTRUCTION

FIELD AND BACKGROUND OF THE INVENTION

This invention relates in general to textile twisting devices and in particular to a new and useful spinning flyer with a twist crown mounted on a flyer head.

The invention relates to a spinning flyer with a twist crown mounted on the flyer head. With such a crown one produces a so-called "false twist," i.e., a twisting of the roving about its longitudinal axis which is stronger than corresponds to the speed of the flyer and which substantially resolves again in the flyer. For this purpose, teeth or other comparable elevations are provided at the inlet of the twist crown. Known twist crowns are made of plastic or similar soft material. One simply slips them over the flyer head, and this causes their tubular shank to expand. The inherent elasticity of this shank is sufficient for clamping attachment of the crown. This simple attachment has the disadvantage of a comparatively short life, that is, relatively rapid wear of the crown in the region of the inlet.

SUMMARY OF THE INVENTION

The object invention provides a spinning flyer with a twist crown mounted on the flyer head whose crown is highly wear resistant, but without making higher demands on the mounting and removal.

In accordance with the invention a spinning flyer comprises a rotatable flyer having spaced apart substantially parallel flyer arms with a central web portion with a head projecting outwardly from the web portion in an opposite direction from the arms. A twist crown is slidably engageable over the head but a securing member between the head and the crown pivots the movement of the twist crown relative to the head and the removal of the twist crown.

By the use of steel or other hard and hence comparatively inelastic material, the wear of the head is very substantially reduced and hence its life greatly lengthened. Yet the placing on and removal of the twist crown is no more difficult than with known flyers, but rather it is possible to carry out these operations at least equally fast. The clamping retention of the twist crown on the flyer head is obtained by means of a securing member of known design. Preferably it consists of a highly elastic ring, in particular an O-ring.

As a development of the invention, the securing member is inserted in a groove of the flyer head or in the region of the head.

The flyer head, like the flyer itself, is made preferably of aluminum. Between the head and the crown a so-called sliding fit is provided, i.e. the clamping retention is brought about exclusively by the securing member. The securing member protrudes about two to three tenths of a millimeter over its groove. As the twist crown is being slipped on, the O-ring is compressed elastically, and the resulting resilience is sufficient for non-rotational retention of the crown on the upper flyer end.

Accordingly, it is an object of the invention to provide a spinning flyer comprising a rotatable flyer having spaced apart substantially parallel flyer arms with a central web portion connected between the arms and with a head projecting outwardly from the web portion in an opposite direction from the arm and wherein a twist crown is slidably engageable over the head and a securing member in the form of an O-ring is engageable between the head and the twist crown inhibits the movement of the twist crown and inhibits its removal from the head.

A further object of the invention is to provide a spinning flyer which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
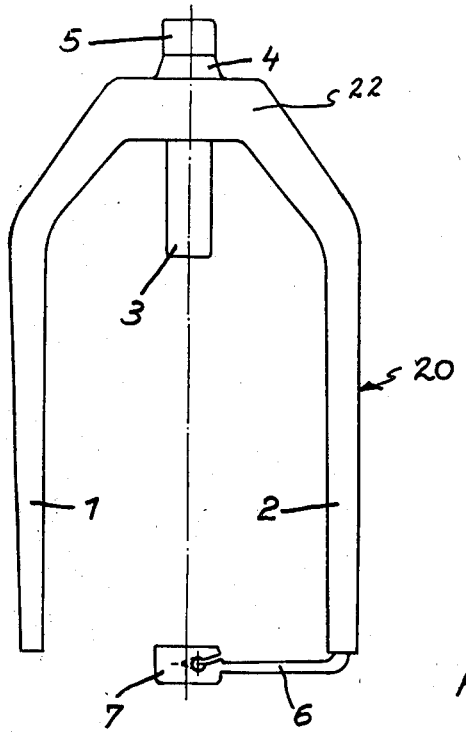
FIG. 1 is a side elevational view of a spinning flyer constructed in accordance with the invention.

Referring to the drawings, in particular the invention embodied therein comprises a spinning flyer 20 having the usual spaced apart parallel arms 1 and 2 connected to a central web portion 22. A head projects outwardly from the web portion in an opposite direction from the arms 1 and 2 and a twist crown 5 is slidably engageable over the head. In accordance with the invention, the twist crown is inhibited from movement in respect to the head by a securing member which is advantageously a resilient band such as an O-ring.

The spinning flyer 20 has a central web portion 22, two parallel arms 1 and 2, a bearing pin 3 extending in the same direction as the arms and a coaxial head 4 pointing in the opposite direction. On the head 4 is slipped a so-called twist crown 5 which is also called a spinning mount. One of the arms, e.g. arm 2, carries further a pivotably mounted presser finger 6 with a slat portion 7 at its outer end.

The twist crown 5 is made of steel, while the flyer head and hence the essential part of the flyer is made of aluminum or similar light-metal casting. In the interior of the head 4, is a cast-in steel guide tube 8 for guiding the roving (not shown). A funnel-shaped inlet 5*a* of the twist crown 5 is toothed or similarly formed, i.e., provided, for example, with oval notches 9. The latter impart a "false twist" to a roving (not shown) running through the inlet 9 and the guide tube 8.

The twist crown 5 has a cylindrical shank 10 which spans or engages over the likewise cylindrical upper portion of the head 4. The shank engages the head 4 with a sliding fit, for example, of the tolerance H 8/h 8. In order to hold the twist crown non-slidingly and non-rotationally all the same, there is inserted in a groove 11 of head 4 a rubber-elastic (elastomer) ring 12, e.g. a so-called O-ring. The resilience produced in the O-ring by compression thereof as the twist crown is being slipped onto the head is sufficient for secure retention of the twist crown. But on the other hand, it permits the easy removal of the twist crown if necessary.

Figure 2:
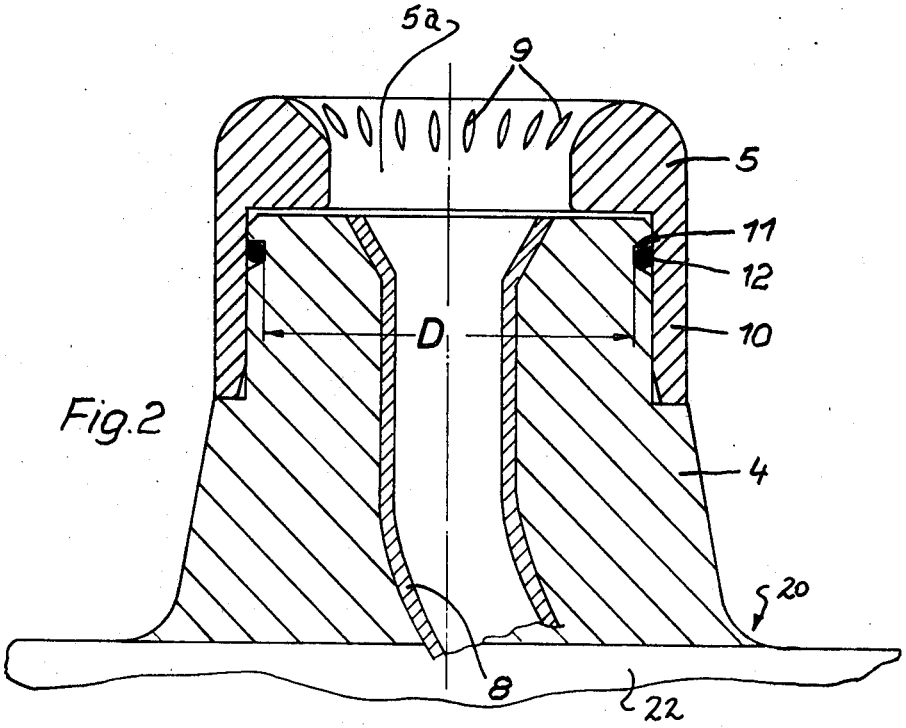
FIG. 2 is an enlarged partial vertical section through the flyer head shown in FIG. 1.

As shown in FIG. 2, a shoulder is formed on head 4 adjacent the cylindrical upper portion thereof, on which shank 10 rests. This defines the lowermost relative position between crown 5 and head 4. It is further noted that the outer surface of shank 10 forms a continuation of the outer surface of head 4 beyond the shoulder.

While a specific embodiment of the invention has been shown and described in detail to illustrate the application of the principles of the invention, it will be understood that the invention may be embodied otherwise without departing from such principles.

What is claimed is:

1. A spinning flyer comprising a rotatable flyer having spaced apart substantially parallel flyer arms with a central web portion connected between said flyer arms, a head projecting outwardly from said web portion in an opposite direction from said arms and having a cylindrical end portion with an annular groove near an outer end of said end portion, a shoulder defined on said head adjacent said cylindrical end portion and extending radially outwardly therefrom, a steel twist crown having a shank with a cylindrical inner surface slidably engaged over said cylindrical end portion of said head, said shank having a lower end resting on said shoulder, said crown further having a funnel shaped and toothed inlet opening of a diameter adjacent said inner surface which is smaller than a diameter of said inner surface, and an elastomer O-ring in said annular groove engaged between said cylindrical end portion of said head and said inner surface of said twist crown shank, for inhibiting the movement of said twist crown relative to said head and for inhibiting the removal of said twist crown from said head.

2. A spinning flyer according to claim 1, wherein said shank has an outer cylindrical surface, said head having an outer surface on a side of said shoulder opposite from said end portion, said outer surfaces of said crown and head forming a continuous surface.

* * * * *